US005602443A

United States Patent [19]

Igeta et al.

[11] Patent Number: 5,602,443

[45] Date of Patent: Feb. 11, 1997

[54] CATHODE-RAY TUBE

[75] Inventors: Shunichi Igeta; Akira Inoue; Minoru Hojo; Hiroo Kobayashi, all of Kyoto; Shiro Takada, Hyogo; Masayuki Miyazaki, Hyogo; Akio Inoue, Hyogo, all of Japan

[73] Assignee: Mitsubishi Denki Kabushiki Kaisha, Tokyo, Japan

[21] Appl. No.: 499,189

[22] Filed: Jul. 7, 1995

[30] Foreign Application Priority Data

Jun. 12, 1994 [JP] Japan ..... 6-302378

[51] Int. Cl.[6] ..... H01J 31/00; H01J 29/70; H01J 1/62; H01J 29/00

[52] U.S. Cl. ..... 313/477 R; 313/422; 313/495; 313/364

[58] Field of Search ..... 313/477 R, 422, 313/495, 364, 25, 573, 634; 174/50.51, 52.4, 52.6; 220/2.3 R, 2.3 A, 2.1 A, 2.2, 2.1 R

[56] References Cited

U.S. PATENT DOCUMENTS

| | | | |
|---|---|---|---|
| 3,064,154 | 11/1962 | Law | 313/422 |
| 4,896,080 | 1/1990 | Tischer | 313/422 |
| 5,031,788 | 7/1991 | Katano | 220/2.1 R |

FOREIGN PATENT DOCUMENTS

| | | |
|---|---|---|
| 1804396 | 1/1968 | Germany . |
| 3445629 | 6/1986 | Germany . |
| 60-100344 | 10/1985 | Japan . |
| 61-58146 | 3/1986 | Japan . |
| 61-181028 | 8/1986 | Japan . |
| 4190545 | 7/1992 | Japan . |
| 4298944 | 3/1993 | Japan . |
| 6267459 | 12/1994 | Japan . |

*Primary Examiner*—Sandra L. O'Shea
*Assistant Examiner*—John Ning

[57] ABSTRACT

A thin flat cathode-ray tube can optimize stress which is generated in each part also when its screen size is increased and maintains high reliability particularly in connection strength in a joint portion between a front glass vessel and a back metal vessel, without deteriorating the joint portion in reliability also in working for mounting electric signal input terminals and an exhaust pipe on the back metal vessel. In the flat cathode-ray tube which is formed by joining side surface portions of the front glass vessel and the back metal vessel with each other, the back metal vessel has the side surface portion of a prescribed width extending along that of the front glass vessel and a bottom surface portion opposed to a fluorescent screen of the front glass vessel, while the bottom surface portion is depressed by a prescribed amount toward the fluorescent portion and a corner portion connecting the side surface portion with the bottom surface portion is at a prescribed radius of curvature.

10 Claims, 16 Drawing Sheets

1 : − 1.0 kgf/mm²
2 : − 0.8
3 : − 0.6
4 : − 0.4
5 : − 0.2
6 : 0
7 : 0.2
8 : 0.4
9 : 0.6
10 : 0.8
11 : 1.0

1 : −1.0 kgf/mm²
2 : −0.8
3 : −0.6
4 : −0.4
5 : −0.2
6 : 0
7 : 0.2
8 : 0.4
9 : 0.6
10 : 0.8
11 : 1.0

CATHODE-RAY TUBE

BACKGROUND OF THE INVENTION

1. Field of the Invention

The present invention relates to a flat cathode-ray tube which is employed for an image display unit such as a television or a display, and more particularly, it relates to a highly reliable vacuum sealing structure which is attained by reducing stress in a joint portion between a front glass vessel and a back metal vessel.

2. Background of the Invention

FIG. 21 schematically shows an exemplary structure of a conventional flat cathode-ray tube. Referring to FIG. 21, numeral 1 denotes a cathode portion serving as an electron beam source, numeral 2 denotes an electron beam control part which is formed by at least one or more electrode plates (2A and 2B in FIG. 21) for controlling an electron beam generated from the cathode portion 1, and numeral 3 denotes a front glass vessel provided with a fluorescent screen 4 which is hit with the electron beam. A vacuum housing 6 is formed by the front glass vessel 3 and a back metal vessel 5. At least one (2A in FIG. 21) of the electrode plates forming the electron beam control part 2 is fixed to a frame 7 and suspended by pins 8 which are mounted on the front glass vessel 3 through springs 9, while the remaining electrode part (2B in FIG. 21) is fixed by joint fittings 13 which are mounted on a side surface portion of the back metal vessel 5. Numeral 10 denotes wiring terminals which are drawn out from the vacuum housing 6 from a joint surface between the front glass vessel 3 and the back metal vessel 5. Numeral 11 denotes a ceramic coating which is plasma-sprayed to the back metal vessel 5, and numeral 12 denotes low melting point glass (frit glass) joining the front glass vessel 3 and the back metal vessel 5 with each other. Numeral 13 denotes the joint fittings for mounting the cathode portion 1 on the back metal vessel 5, numeral 14 denotes electric signal input terminals for the cathode portion 1 etc., and numeral 15 denotes a metal exhaust pipe. Numeral 16 denotes internal wires for electrically connecting the electric signal input terminals 14 with the cathode portion 1, and numeral 18 denotes a wiring substrate forming a wiring pattern by a metal conductive film.

The operation principle of the flat cathode-ray tube shown in FIG. 21 is now briefly described. A prescribed voltage is applied from the electric signal input terminals 14 to the cathode portion 1 in the structure shown in FIG. 21, so that an electron beam is generated from the cathode portion 1. Further, a potential is applied from an external power supply circuit (not shown) to the electron beam control part 2 through the wiring substrate 18 for accelerating or modulating the electron beam which is generated from the cathode portion 1, so that the electron beam correctly hits a determined position of the fluorescent screen 4 provided on the front glass vessel 3. This operation is repeated to visually reproduce images.

In the conventional flat cathode-ray tube shown in FIG. 21, the respective side surface portions of the front glass vessel 3 and the back metal vessel 5 are strongly joined with each other through the frit glass 12. In employment, a general cathode-ray tube enters an ultrahigh vacuum state of not more than $10^{-5}$ Pa, with occurrence of extremely high stress.

Further, the vessel is deformed due to the vacuum pressure, as a matter of course. When the bottom surface is flat as shown in FIG. 21, the back metal vessel 5 is extremely deformed to cause remarkable stress in the joint portion between the same and the front glass vessel 3. Thus, sufficient connection strength cannot be attained and the structure is insufficient for serving as a vacuum housing.

In the conventional structure, in addition, stress on the front glass vessel 3 is also increased and the cathode-ray tube is unsatisfactory as a vacuum housing. Particularly in the structure receiving the wiring terminals 10, the joint portion between the front glass vessel 3 and the back metal vessel 5 is disadvantageous in reliability.

In a general flat cathode-ray tube, further, it is important to minimize the overall depth thereby reducing its thickness.

SUMMARY OF THE INVENTION

According to a first aspect of the present invention, a flat cathode-ray tube comprises a vacuum housing which is formed by joining side surface portions of a front glass vessel and a back metal vessel with each other, a cathode portion which is provided on the back metal vessel side, and electron beam control means for controlling collision of an electron beam generated from the cathode portion onto a fluorescent screen which is applied to an inner surface of the front glass vessel, while the back metal vessel has the side surface portion of a prescribed width extending toward the side surface portion of the front glass vessel and a bottom surface portion which is opposite to the fluorescent screen of the front glass vessel, the bottom surface portion is provided with depression of a prescribed amount which is bent toward the fluorescent screen, and a corner portion along the side surface portion and the bottom surface portion is formed to have a prescribed radius R of curvature.

According to the first aspect of the present invention, it is possible to provide a flat cathode-ray tube having a highly reliable vacuum sealing structure which can reduce stress in the joint portion between the front glass vessel and the back metal vessel by providing the prescribed amount of depression on the fluorescent screen side of the bottom surface portion of the back metal vessel while providing the corner portion along the side surface portion and the bottom surface portion at the prescribed radius of curvature.

According to a second aspect of the present invention, the amount d of the depression provided on the bottom portion and the radius R of curvature of the corner portion are set in the following ranges:

$0.3\ h \leqq d \leqq 0.5\ h$ $0.1\ h \leqq R \leqq 0.3\ h$ where h represents the full height of the back metal vessel.

According to the second aspect of the present invention, it is possible to provide a flat cathode-ray tube having a more reliable vacuum sealing structure since stress can be optimumly reduced around the joint portion by setting the amount d of the depression in the bottom surface portion of the back metal vessel and the radius R of curvature of the corner portion along the side surface portion and the bottom surface portion in the ranges of $0.3\ h \leqq d \leqq 0.5\ h$ and $0.1\ h \leqq R \leqq 0.3\ h$ respectively, where h represents the full height of the back metal vessel.

Preferably, the amount d of the depression and the radius R of curvature are substantially in the following relation:

$R<d<2R$

According to a third aspect of the present invention, the side surface portion of the back metal vessel is in the form of a substantially rectangular frame having a pair of opposite longer side portions and a pair of opposite shorter side portions, and a drawing depth S of the shorter side portions is set in the following range:

$0<S\leqq 0.5\ h$ assuming that h represents the full height of the back metal vessel.

According to the third aspect of the present invention, it is possible to provide a flat cathode-ray tube having a highly reliable vacuum sealing structure since stress can be optimumly reduced around the joint portion by setting the drawing depth S of the shorter side portions of the back metal vessel in the range of $0<S\leqq 0.5\ h$, where h represents the full height of the back metal vessel.

Preferably, the drawing depth S of the shorter side portions is set to be smaller than that of the longer side portions.

According to a fourth aspect of the present invention, a plurality of rib structures are integrally formed on the bottom surface portion of the back metal vessel.

According to the fourth aspect of the present invention, it is possible to provide a flat cathode-ray tube having a highly reliable vacuum sealing structure and a reduced weight since flexural rigidity of the back metal vessel is increased while maintaining a small thickness due to the plurality of rib structures integrally formed on the bottom surface portion of the back metal vessel.

According to a fifth aspect of the present invention, a radiation fin is arranged on the bottom surface portion of the back metal vessel to be received in the depression.

According to the fifth aspect of the present invention, it is possible to further improve the reliability also by a radiation effect since the radiating fin can be mounted without increasing the overall depth by arranging the radiating fin on the bottom portion of the back metal vessel to be received in the depression.

According to a sixth aspect of the present invention, $G\leqq 0.25\ h$ in a joint portion between the side surface portions of the front glass vessel and the back metal vessel, assuming that G represents the amount of displacement between thickness centers of the side surface portions of the front glass vessel and the back metal vessel and h represents the full height of the back metal vessel.

According to the sixth aspect of the present invention, it is possible to provide a flat cathode-ray tube having a further reliable vacuum sealing structure since stress can be optimumly reduced around the joint portion by setting the amount G of displacement between thickness centers of the side surface portions of the front glass vessel and the back metal vessel in the range of $G\leqq 0.25\ h$, where h represents the full height of the back metal vessel, in the joint portion.

According to a seventh aspect of the present invention, an electric signal input terminal and an exhaust pipe are arranged in the ranges of $L_1/3$ and $L_2/3$ from a face center of the bottom surface portion of the back metal vessel along longer and shorter sides of the bottom surface portion respectively assuming that $L_1$ and $L_2$ represent lengths of the longer and shorter sides respectively.

According to the seventh aspect of the present invention, it is possible to provide a flat cathode-ray tube having a highly reliable vacuum sealing structure with a reduced thickness since the overall depth can be suppressed from increase in size while influence of stress exerted on the joint portion between the front glass vessel and the back metal vessel can be reduced by arranging the electric signal input terminal and the exhaust pipe in a structurally stable range having small stress which is the depression at the substantially central portion in the bottom surface portion of the back metal vessel.

An object of the present invention is to obtain a highly reliable thin flat cathode-ray tube, which can maintain strength of a joint portion between a front glass vessel and a back metal vessel by reducing stress in the vicinity of the joint portion also when its screen size is increased.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiment 1

An embodiment 1 of the present invention is now described with reference to the drawings.

Figure 1:
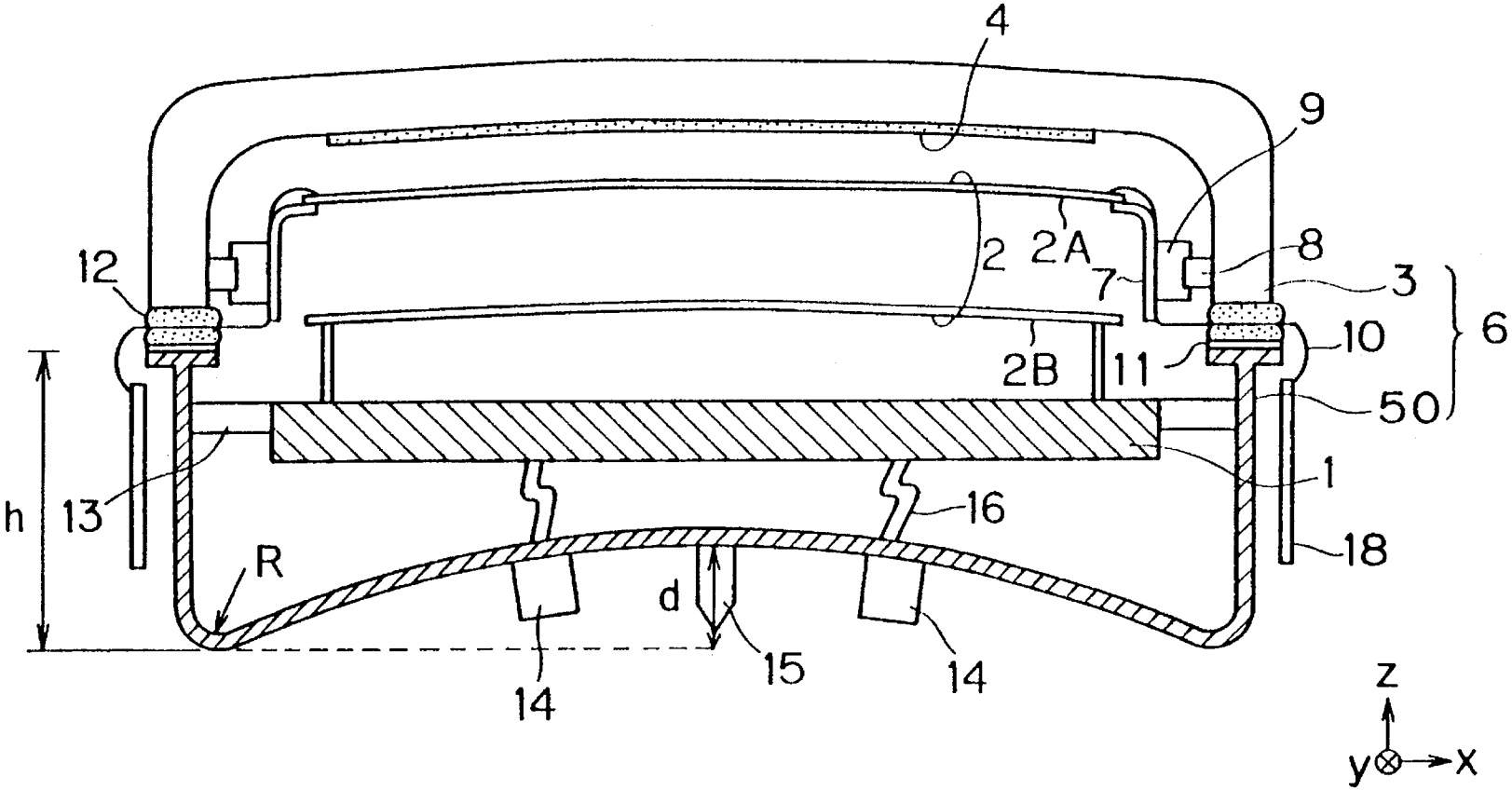
FIG. 1 is a schematic block diagram for illustrating an embodiment 1 of the present invention.
Figure 21:
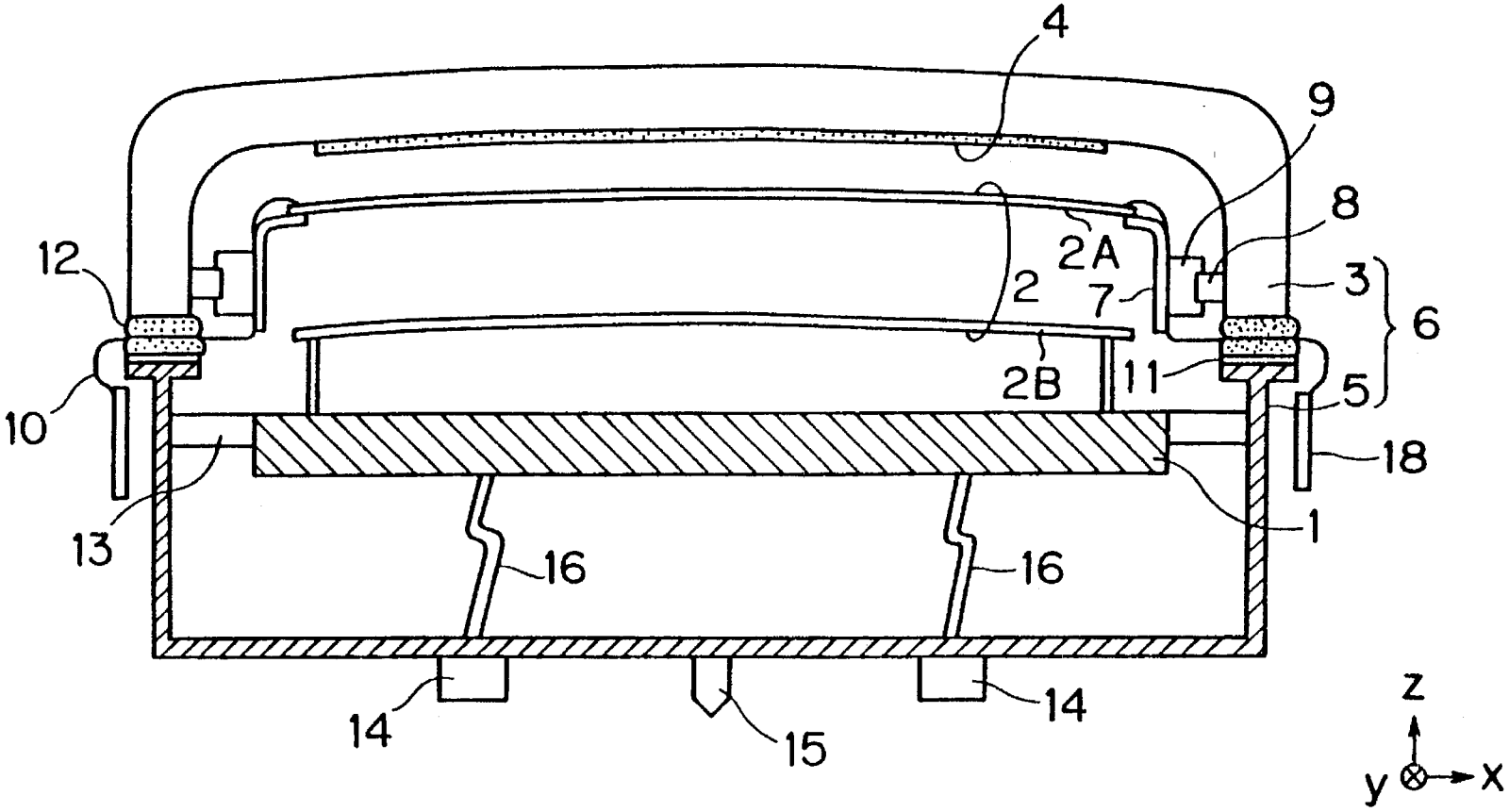
FIG. 21 is a schematic block diagram showing a conventional flat cathode-ray tube.

FIG. 1 is a schematic block diagram showing an exemplary flat cathode-ray tube according to the present invention. In this figure, portions identical or corresponding to those of the prior art shown in FIG. 21 are denoted by the same reference numerals.

Referring to FIG. 1, numeral 1 denotes a cathode portion serving as an electron beam source, numeral 2 denotes an electron beam control part which is formed by at least one or more electrode plates (2A and 2B in FIG. 1) for controlling an electron beam generated from the cathode portion 1, and numeral 3 denotes a front glass vessel provided with a fluorescent screen 4 which is hit with the electron beam.

Numeral 50 denotes a back metal vessel, which is a member having a structure most characterizing the present invention, provided with a side surface portion of a prescribed width extending toward the front glass vessel 3 and a bottom surface portion which is opposite to the fluorescent screen of the front glass vessel 3. The bottom surface portion of the back metal vessel 50 is provided with depression of a prescribed amount on the fluorescent screen side, and a continuously curved corner portion along the side surface portion and the bottom surface portion which is set at a prescribed radius of curvature.

A vacuum housing 6 is formed by the front glass vessel 3 and the back metal vessel 50. At least one (2A in FIG. 1) of the electrode plates forming the electron beam control part 2 is fixed to a frame 7 and suspended by pins 8 which are mounted on the front glass vessel 3 through springs 9, while the remaining electrode plate (2B in FIG. 1) is fixed by joint fittings 13 which are mounted on the side surface portion of the back metal vessel 50. Numeral 10 denotes wiring terminals which are drawn out from the vacuum housing 6 from a joint surface between the front glass vessel 3 and the back metal vessel 50. Numeral 11 denotes a ceramic coating which is plasma-sprayed to the back metal vessel 50, and numeral 12 denotes low melting point glass (frit glass) connecting the front glass vessel 3 and the back metal vessel 5 with each other. Numeral 13 denotes the joint fittings for mounting the cathode portion 1 on the back metal vessel 50, numeral 14 denotes electric signal input terminals for the cathode portion 1 etc., and numeral 15 denotes a metal exhaust pipe. Numeral 16 denotes internal wires for electrically connecting the electric signal input terminals 14 with the cathode portion 1, and numeral 18 denotes a wiring substrate forming a wiring pattern by a metal conductive film.

As to the operation, a prescribed voltage is applied from the electric signal input terminals 14 to the cathode portion 1 in the structure shown in FIG. 1 similarly to the operation described with reference to the prior art, so that an electron beam is generated from the cathode portion 1. Further, a potential is applied from an external power supply circuit (not shown) to the electron beam control part 2 through the wiring substrate 18 for accelerating or modulating the electron beam which is generated in the cathode portion 1, so that the electron beam correctly hits a determined position of the fluorescent screen 4 which is formed on the front glass vessel 3. This operation is repeated to visually reproduce images.

Figure 2:
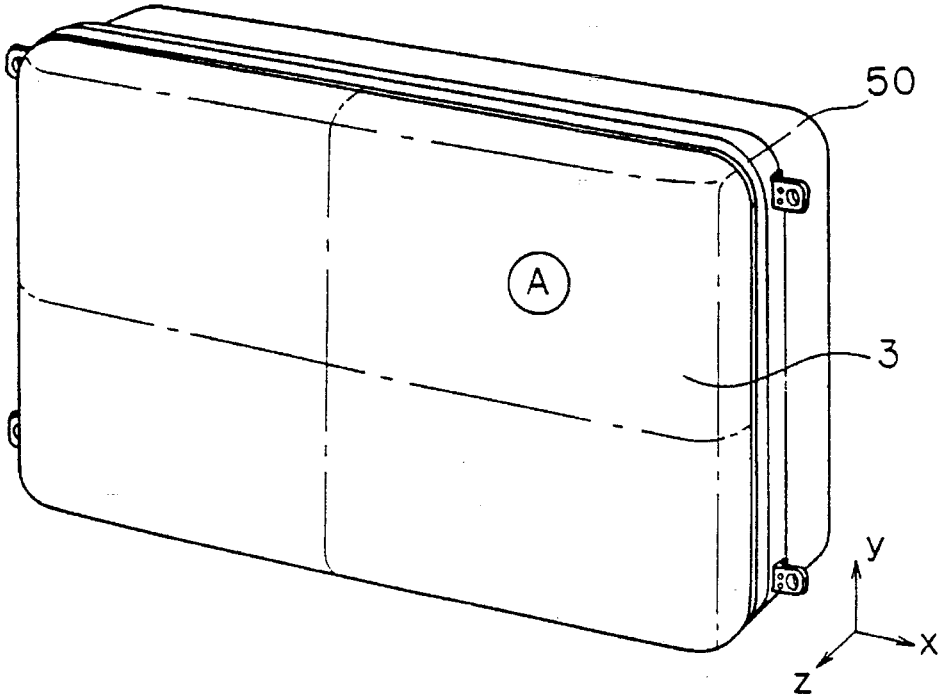
FIG. 2 is a front perspective view for illustrating the embodiment 1.
Figure 3:
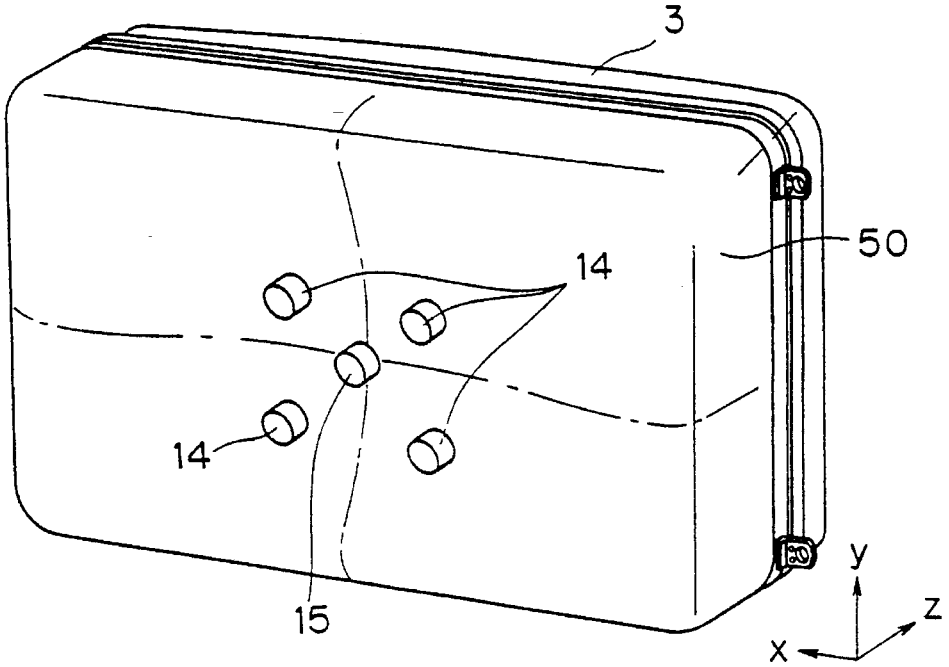
FIG. 3 is a rear perspective view for illustrating the embodiment 1.

FIGS. 2 and 3 solidly illustrate the appearance of the cathode-ray tube shown in FIG. 1 from a front perspective and a rear perspective, respectively.

Figure 4:
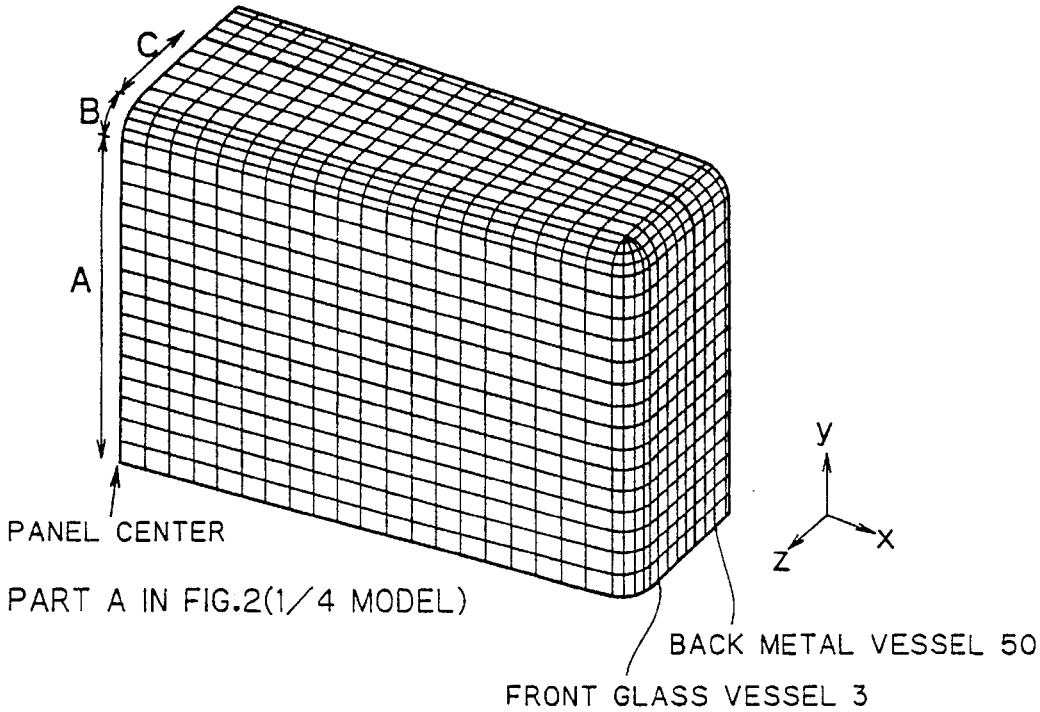
FIG. 4 is a model diagram for FEM analysis.
Figure 5:
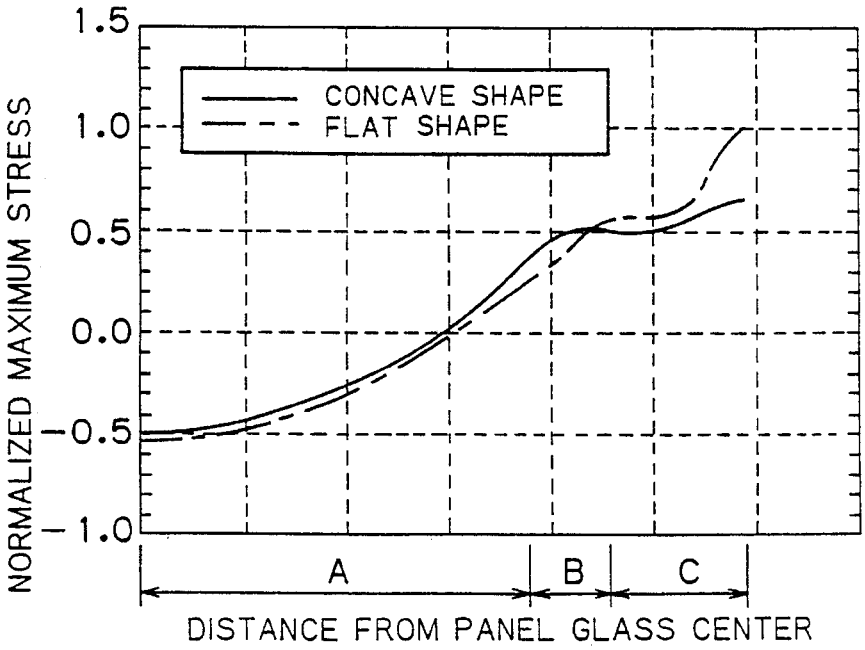
FIG. 5 illustrates exemplary results of FEM analysis for illustrating difference between shapes of bottom surface portions of back metal vessels.

It is possible to support a vacuum pressure by in-plane internal force by depressing the bottom portion of the back metal vessel 50 having the side surface portion toward the fluorescent screen 4, as shown in FIG. 1. FIG. 5 illustrates a result of FEM (finite element method) analysis on a part A (¼ model) in FIG. 2, and FIG. 4 is a model diagram thereof. As understood from FIG. 5, stress remarkably appears around a joint portion (C zone) between the glass and the metal, which is important in structure, in a flat cathode-ray tube having a flat back metal vessel similarly to that of the prior art.

On the other hand, stress on the C zone is relaxed in the cathode-ray tube according to the present invention having the substantially concave back metal vessel 50. Thus, it is possible to suppress the amount(s) of deflection of the back metal vessel 50 (and the front glass vessel 3), while reducing stress resulting from bending.

Figure 6:
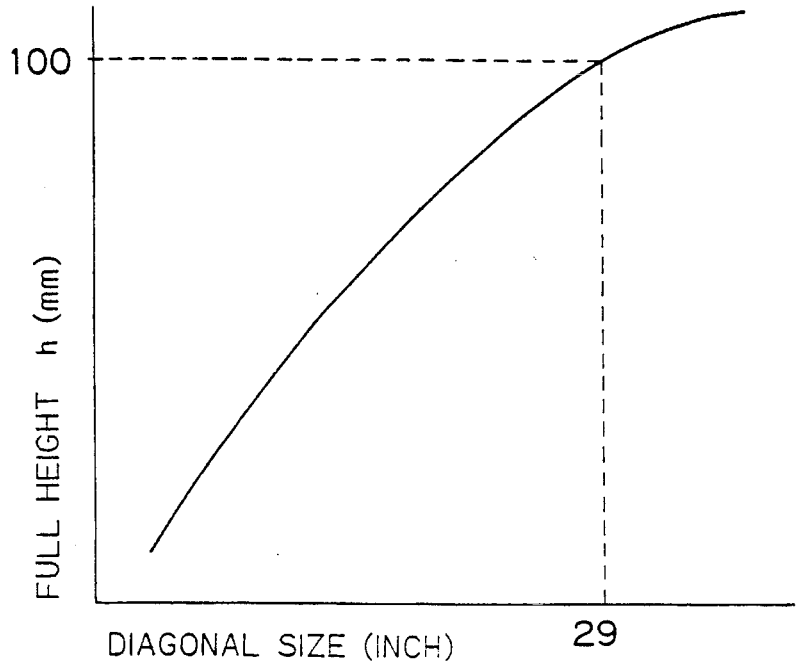
FIG. 6 is a graph showing the relation between a diagonal size and a full height h.

FIG. 6 is a graph showing the relation between a diagonal size of the housing 6 and the full height h of the back metal vessel 50. As clearly understood from FIG. 6, the full height h is substantially proportional to the diagonal size. When the diagonal size is 29 inches, for example, the full height h is 100 mm (the following embodiments are also described with reference to the diagonal size of 29 inches and the full height h of 100 mm).

Figure 7:
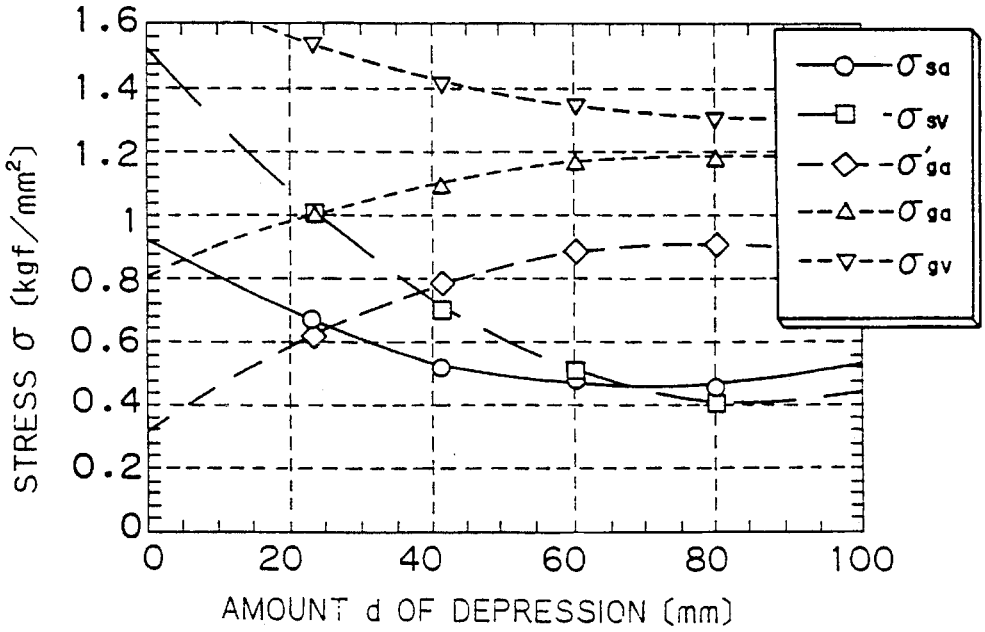
FIG. 7 shows an exemplary result of FEM analysis illustrating the relation between amounts d of depression and stress values.
Figure 8:
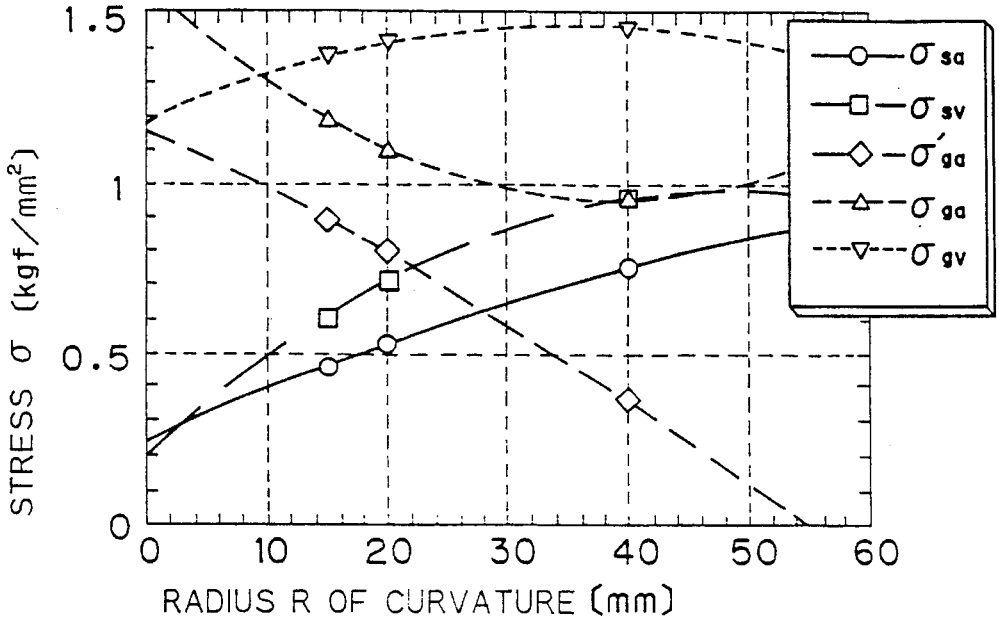
FIG. 8 shows an exemplary result of FEM analysis illustrating the relation between radii R of curvature and stress values.

FIG. 7 shows the relation between amounts d of depression and stress, and FIG. 8 shows the relation between radii R of curvature of the corner portion connecting the side surface portion with the bottom portion and stress values in relation to results of FEM analysis. Symbol $\sigma sa$ represents atmosphere side stress in the front glass vessel 3 around the joint portion with the back metal vessel 50, symbol $\sigma sv$ represents vacuum side stress in the front glass vessel 3 around the joint portion with the back metal vessel 50, symbol $\sigma'ga$ represents stress in the front glass vessel 3 on a front part (fluorescent screen) atmosphere side, symbol $\sigma ga$ represents overall atmosphere side stress in the front glass vessel 3, and symbol $\sigma gv$ represents overall vacuum side stress in the front glass vessel 3. These values $\sigma sa$, $\sigma sv$, $\sigma'ga$, $\sigma ga$ and $\sigma gv$ are noted and evaluated since these are the maximum values of the respective stress values on stress distribution, which are directly related to structural strength.

Statistically processing strength data obtained by experiments which have heretofore been made by the inventors and making study thereof on the basis of evaluation with allowable values of at least 99.999% in reliability (probability of survival), it has been proved that a back metal vessel having a full height h of about 100 mm, for example, is effective when the amount d of the central depression is about 40 mm and the radius R of curvature of the corner portion connecting the side surface portion with the bottom portion is about 20 mm from FIGS. 7 and 8, respectively.

When attention is particularly drawn to $\sigma sa$ for taking it into consideration that $\sigma sa$ is present in the range of about 0.4 to 0.6 kgf/mm $^2$ (empirical value for causing no separation of the joint portion on the process in a state of drawing out the wiring terminals 10) and stress values on other portions are well-balanced as a whole in consideration of material specification and working conditions, the amount d of depression and the radius R of curvature can be selected from about 30 to 50 mm and from about 10 to 30 mm respectively. Namely, it is effective to set these values in the ranges of $0.3\ h \leqq d \leqq 0.5\ h$ and $0.1\ h \leqq R \leqq 0.3\ h$ respectively. Correlation between the amount d of depression and the radius R of curvature is present in about $R<d<2R$ regardless of the sizes.

As an advantage of such a concave shape, the overall depth of the flat cathode-ray tube can be reduced, since the length of the exhaust pipe 15 is settled in the depression provided in the concave portion of the back metal vessel 50.

The thickness of the back metal vessel 50 can be reduced as compared with that of the conventional flat cathode-ray tube, whereby the total weight can also be remarkably reduced.

Embodiment 2

Figure 9A:
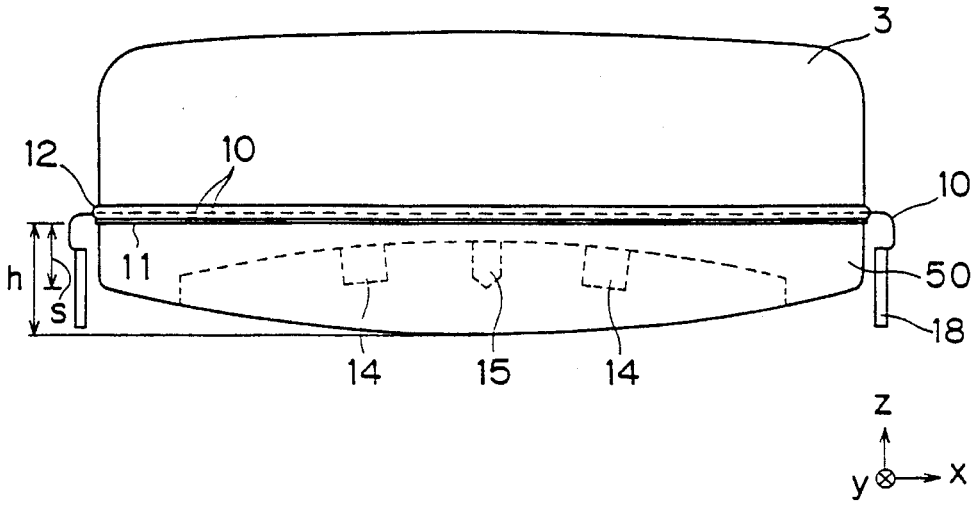
FIGS. 9A and 9B are schematic block diagrams for illustrating an embodiment 2 of the present invention.
Figure 9B:
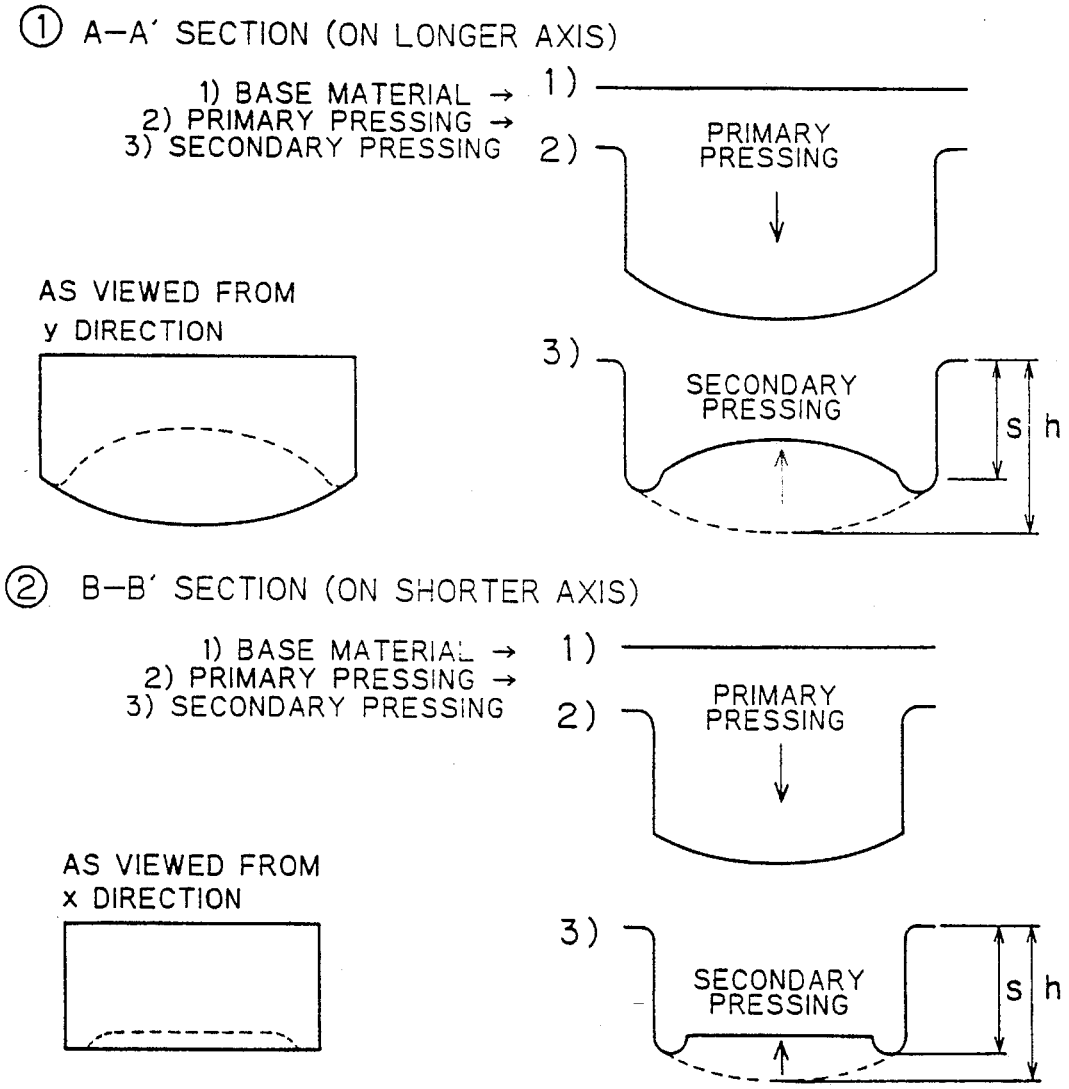
Figure 10:
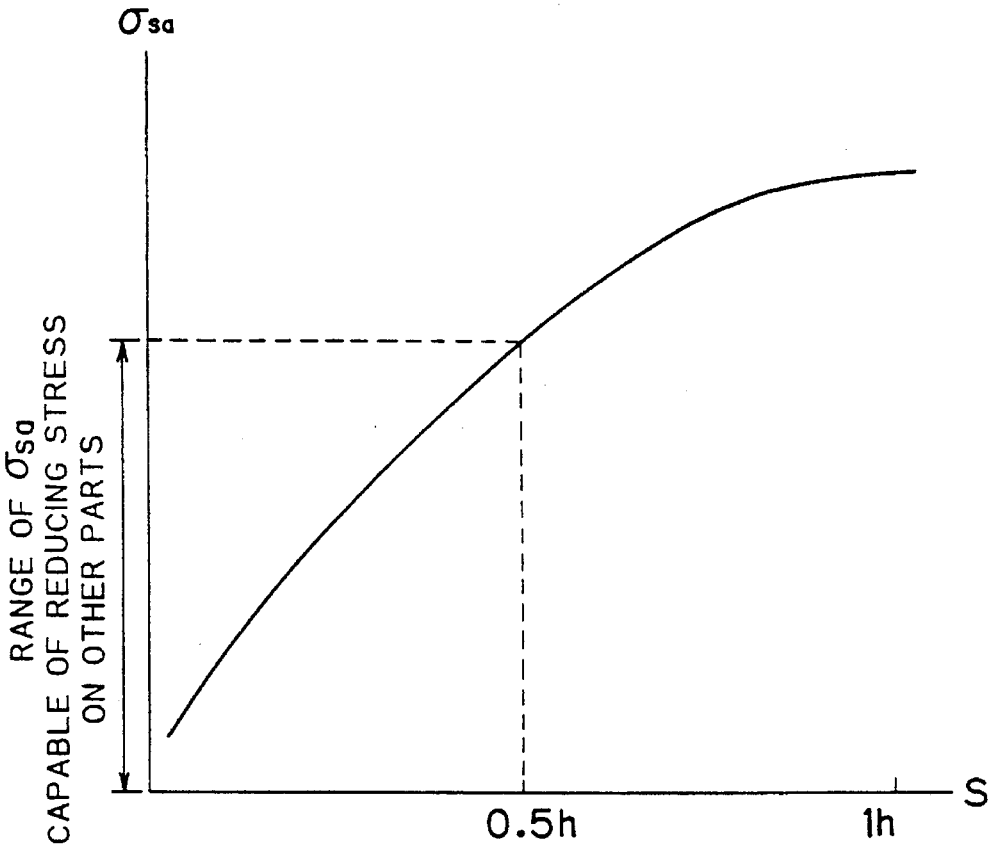
FIG. 10 is a graph showing the relation between a drawing depth S and stress $\sigma sa$.
Figure 11:
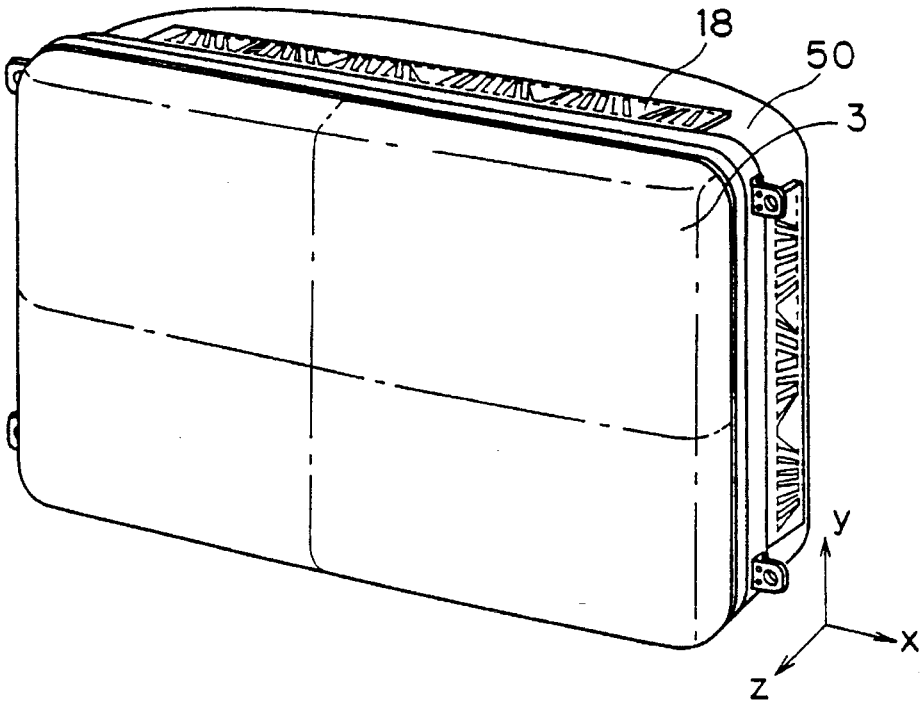
FIG. 11 is a front perspective view for illustrating the embodiment 2.
Figure 12:
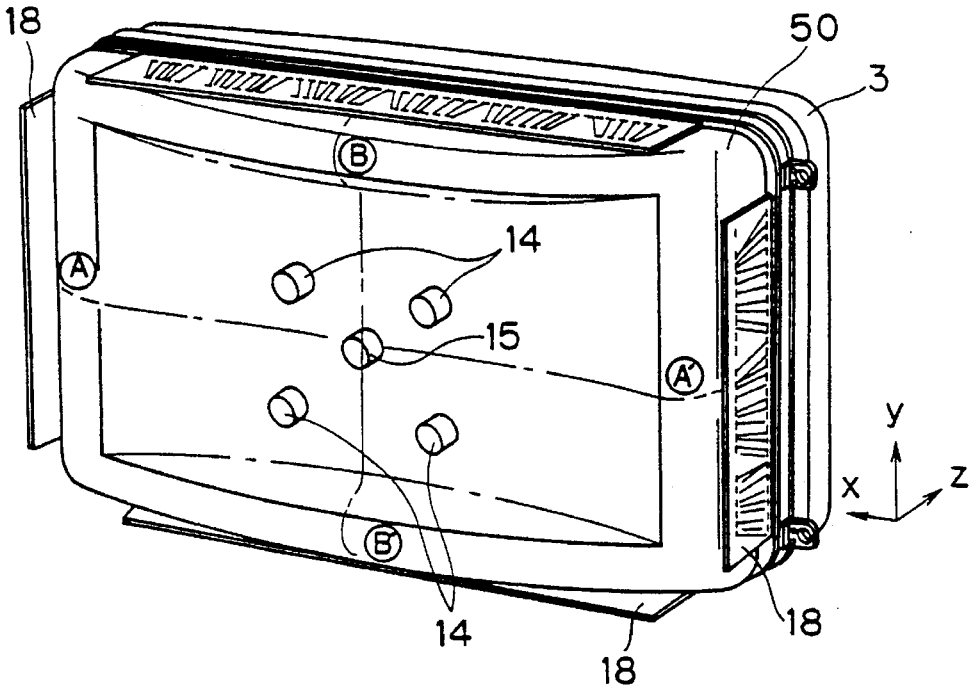
FIG. 12 is a rear perspective view for illustrating the embodiment 2.

While merely the bottom surface portion of the back metal vessel 50 is defined as concave in the embodiment 1, rigidity can be further structurally increased according to an embodiment 2 of the present invention, by shallowly drawing both shorter sides (a pair of shorter side portions) of a back metal vessel 50 with respect to a tube axis (z axis) direction while deeply drawing both longer sides (a pair of longer side portions) thereof. FIGS. 9A and 9B show the structure of a flat cathode-ray tube according to this embodiment. FIG. 10 is a graph showing the result of FEM analysis executed on the model shown in FIG. 9A. It has been proved from FIG. 10 that a drawing depth S of each shorter side which is effective for reducing overall stress may be about 0.5 times the full height h at the maximum. In a design concept in relation to an attached cabinet, the apparent overall depth is reduced by shallowly drawing the shorter sides. FIGS. 11 and 12 are perspective views showing the appearance of the cathode-ray tube according to the embodiment 2.

Drawing is generally carried out by pressing. In order to attain the shape of the back metal vessel 50 shown in FIG. 12, the longer and shorter sides must be in different shapes.

As shown in FIG. 9B, shapes in primary pressing are maintained in secondary pressing on the longer sides, while the shorter sides are inwardly projected in secondary pressing. The shape shown in FIG. 12 is formed through such a process.

At this time, the full height h of the back metal vessel 50 and the drawing depth S of the shorter sides are defined in the range of $0<S \leqq 0.5$ h.

Embodiment 3

Figure 13:
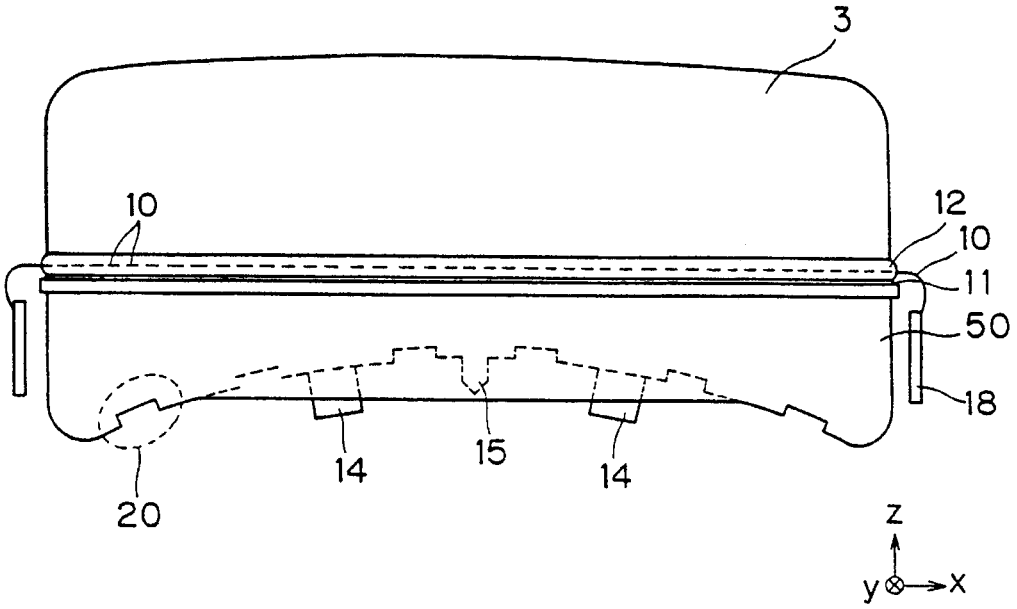
FIG. 13 is a schematic block diagram for illustrating an embodiment 3 of the present invention.

While the structural shape with respect to vacuum stress is considered on the basis of the shape of the bottom surface portion of the back metal vessel 50 in each of the embodiments 1 and 2, a plurality of rib structures (irregular shapes) 20 are integrally formed on a bottom surface portion of a back metal vessel 50 in an embodiment 3 of the present invention, as shown in FIG. 13. The number, the pitch, the height and manners of vertical and transverse arrangement of the rib structures 20 are decided in response to the size of the back metal vessel 50. Due to the plurality of rib structures 20, flexural rigidity is increased to reduce stress, whereby an effect similar to that in case of increasing the thickness can be attained. Therefore, it is possible to reduce the stress without increasing the thickness of the back metal vessel 50.

Embodiment 4

Figure 14:
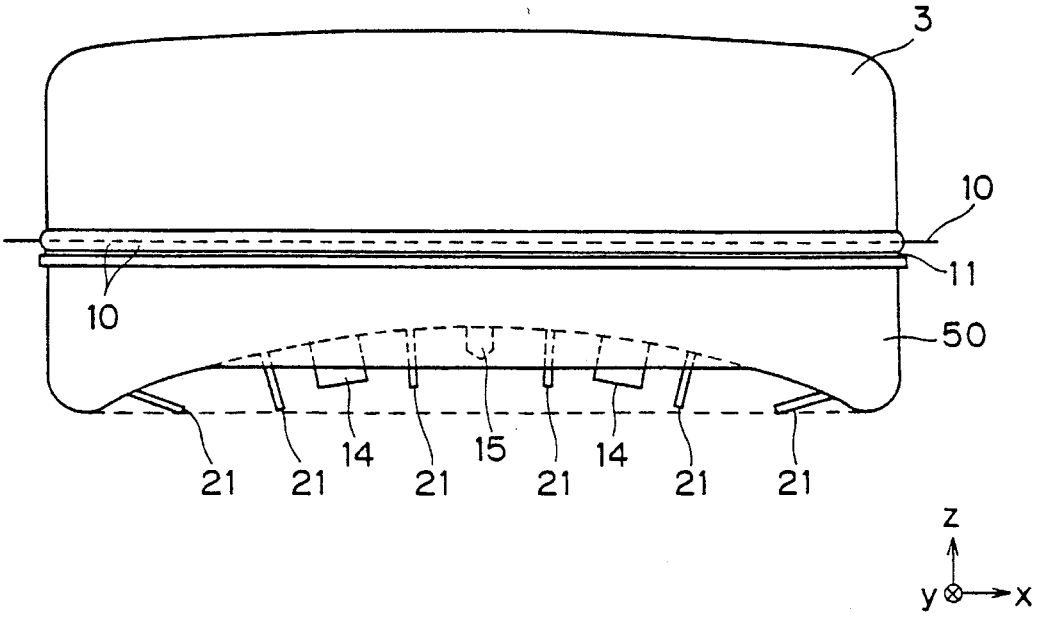
FIG. 14 is a schematic block diagram for illustrating an embodiment 4 of the present invention.

While the rib structures 20 which are integrated with the base material for reducing stress are proposed in the embodiment 3, radiating fin structures 21 are provided in a depressed portion of a bottom surface portion of a back metal vessel 50 in an embodiment 4 of the present invention, as means for radiating heat which is stored in the back metal vessel 50 during operations. FIG. 14 shows an outline thereof. The radiating fin structures 21 are connected with the back metal vessel 50 by an adhesive or a brazing material, or through metal welding. The sizes of the radiating fin structures 21 are designed with sufficient consideration of the operating temperature.

Embodiment 5

Figure 15:
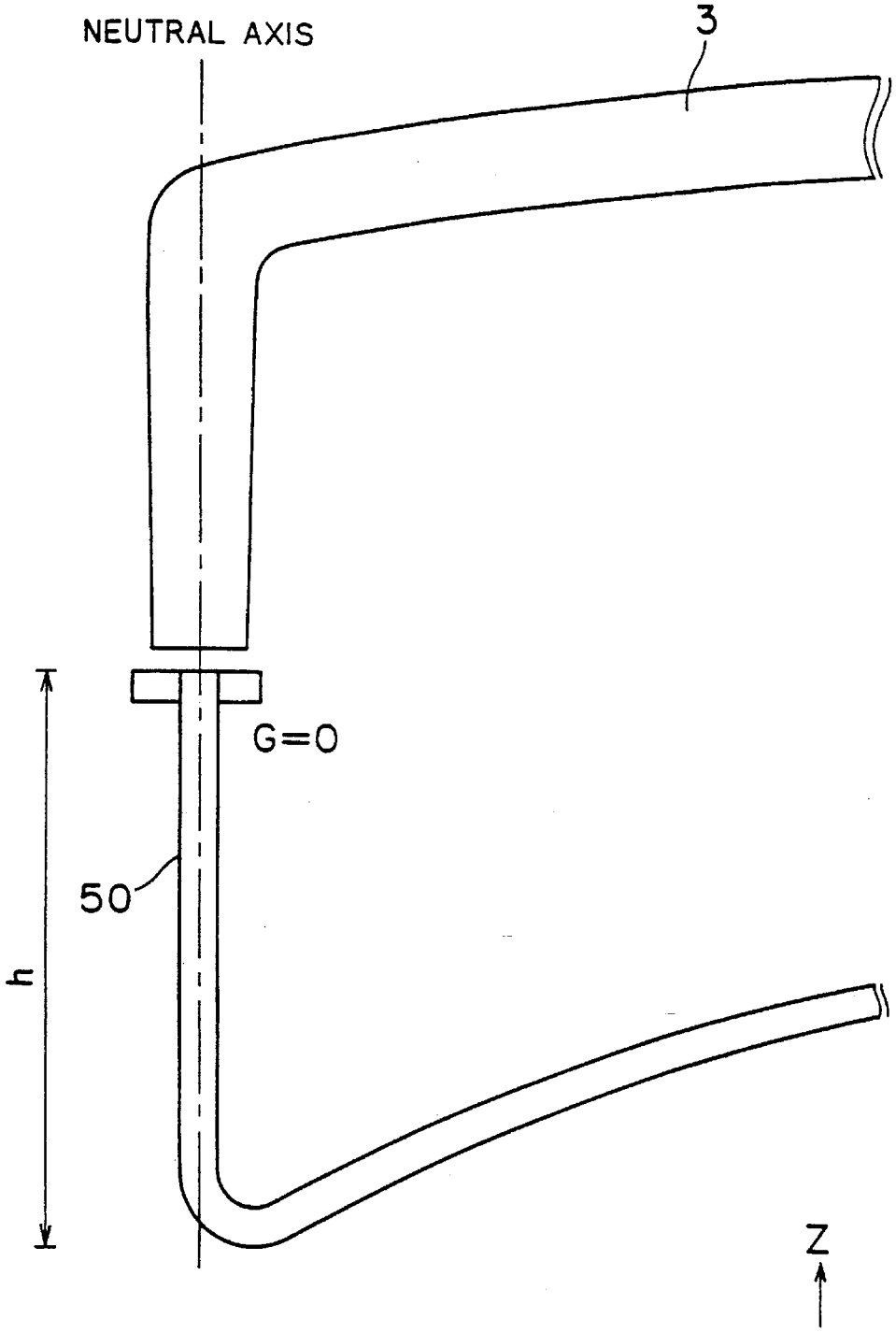
FIG. 15 is adapted to illustrate neutral axes in a joint portion between a front glass vessel and a back metal vessel.
Figure 16:
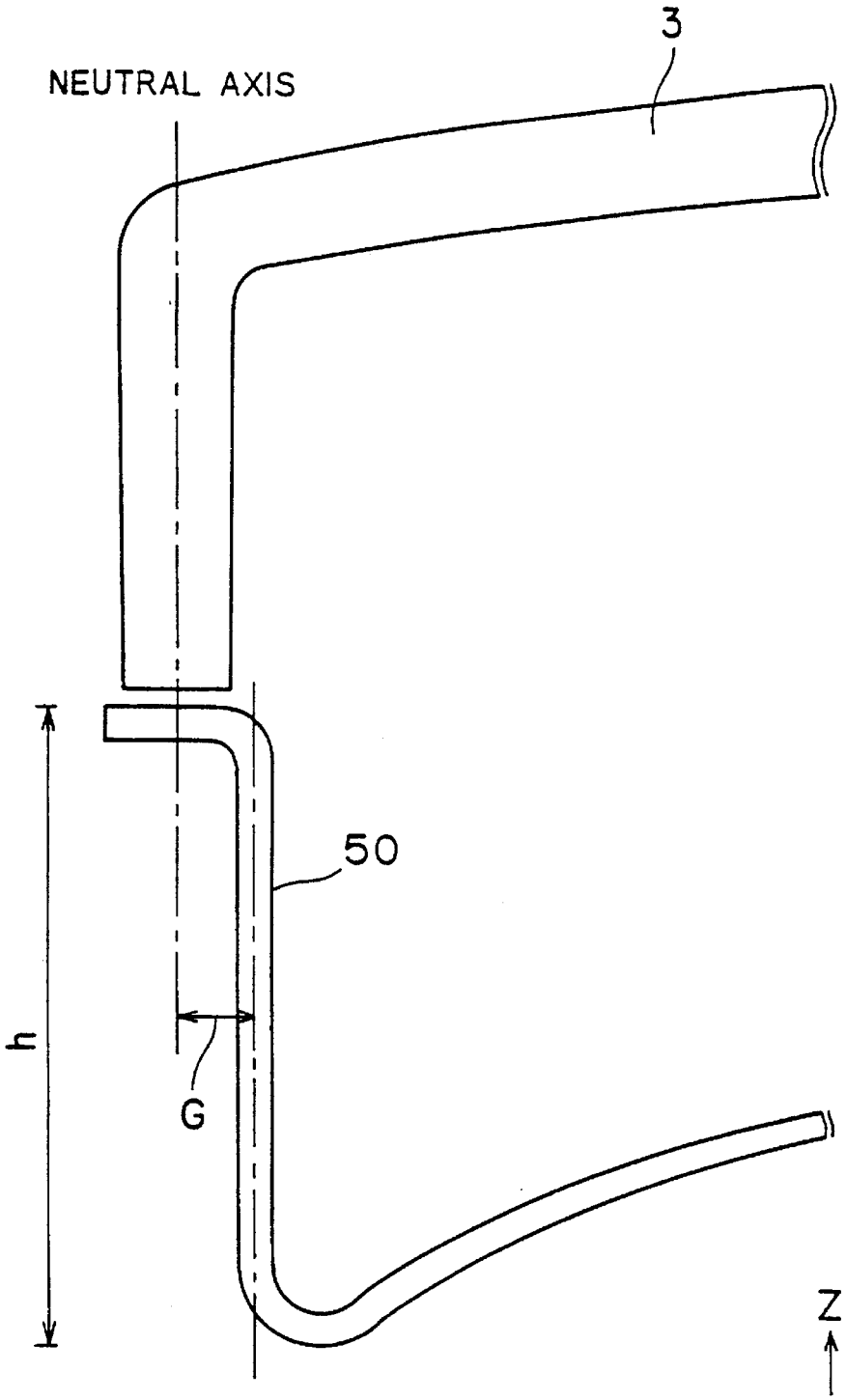
FIG. 16 is adapted to illustrate displacement between the neutral axes.
Figure 17:
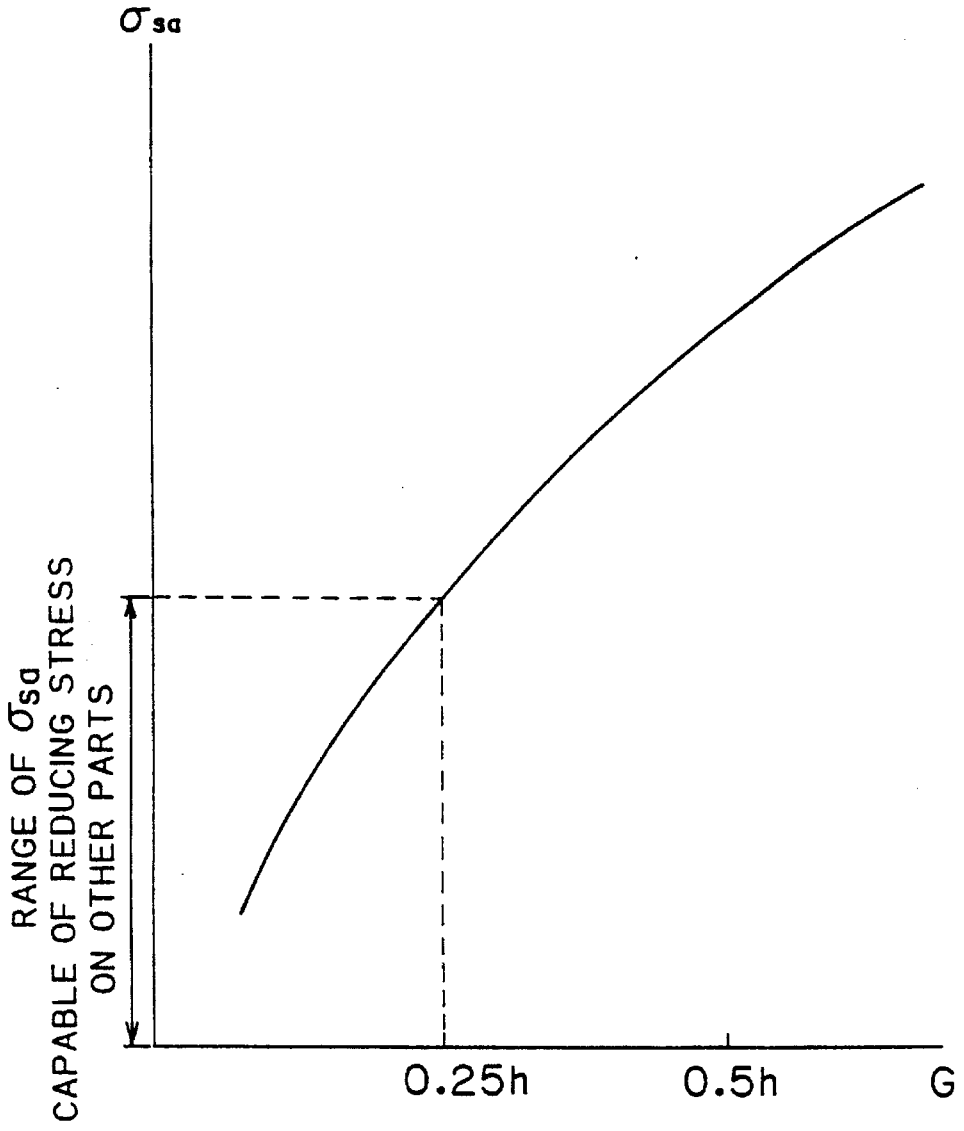
FIG. 17 is a graph showing the relation between an amount G of displacement and stress $\sigma sa$.

An embodiment 5 of the present invention is adapted to define an amount of displacement between neutral axes in a joint portion between a front glass vessel 3 and a back metal vessel 50. As the result of various experiments and FEM analysis made by the inventors, it has been proved that the amount G of displacement is ideally zeroed when the respective neutral axes are aligned with each other as shown in FIG. 15. Also when the amount G of displacement is not more than 0.25 h with respect to the full height h as shown in FIG. 16, atmosphere side stress $\sigma sa$ in the front glass vessel 3 around the joint portion with the back metal vessel 50 can be suppressed to a level capable of maintaining sealing strength, as understood from FIG. 17.

Embodiment 6

Figure 18:
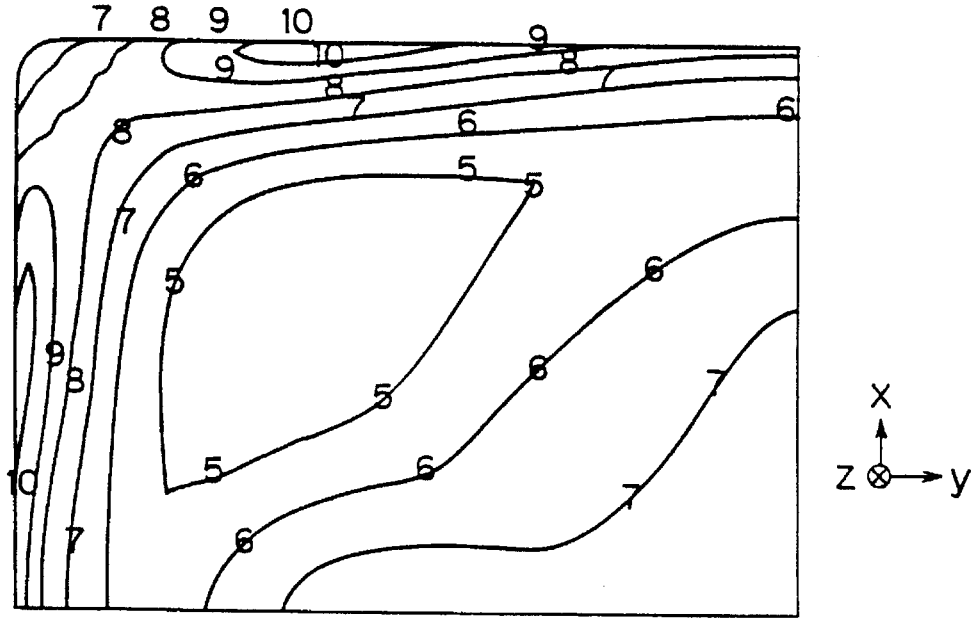
FIG. 18 illustrates a result of FEM analysis showing stress distribution on an atmosphere side of a back metal vessel.
Figure 19:
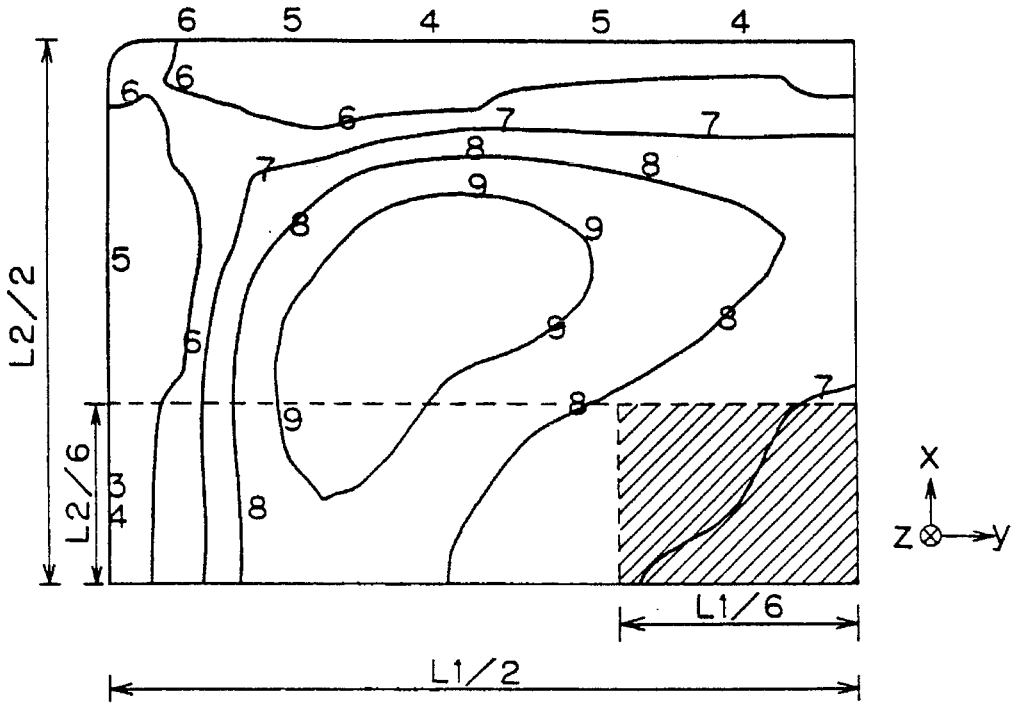
FIG. 19 illustrates a result of FEM analysis showing stress distribution on a vacuum side of the back metal vessel.

FIGS. 18 and 19 show examples of stress distribution of a back metal vessel in FEM analysis on a model having a diagonal size of 29 inches (h=100 mm). FIG. 18 shows distribution on an atmosphere side, while FIG. 19 shows that on a vacuum side. The object of analysis is limited to a ¼ quadrant, in consideration of symmetry of the model. It is understood from the distribution that the range (slant line portion in FIG. 19) enclosed with ⅓ lengths of longer and shorter side lengths L1 and L2 is structurally stable with small stress. This is a preferable range for carrying out welding on a portion having small stress by piercing the bottom surface of the back metal vessel 50 and mounting electric signal input terminals 14 and an exhaust pipe 15 by welding such as electron beam welding, TIG welding or laser welding.

Figure 20:
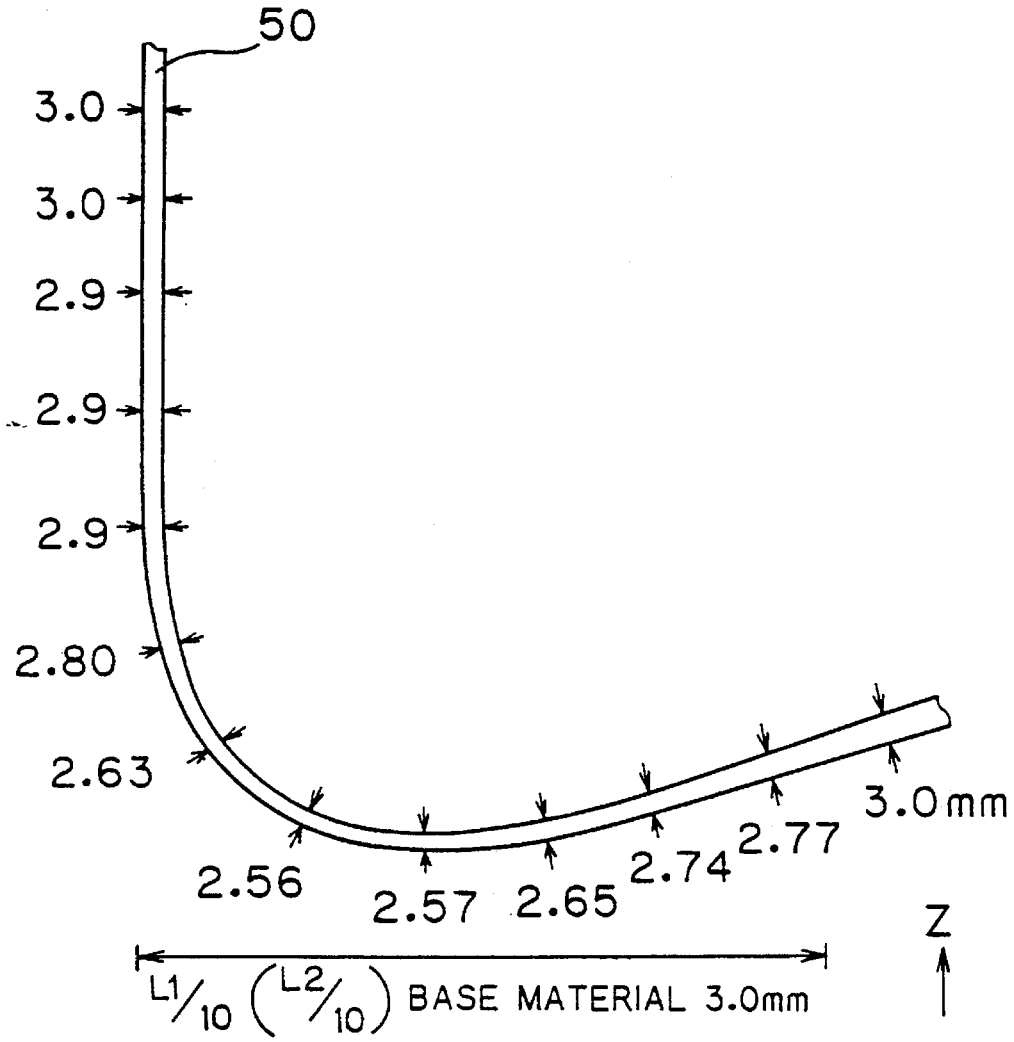
FIG. 20 illustrates data of thickness change measured in case of molding a back metal vessel by pressing.

FIG. 20 shows exemplary thickness change of a base material (initial thickness: 3 mm) in case of forming the back metal vessel 50 by pressing. It is clearly understood that the thickness of the back metal vessel 50 with deep drawing is reduced around a radius R of curvature (distributed in about 1/10 of $L_1$ and 1/10 of $L_2$) while the initial thickness is maintained in a central portion of the back metal vessel 50 enclosed with $L_1/3$ and $L_2/3$ and hence no problem is caused also when the exhaust pipe 15 and the electric signal input terminals 14 are mounted (high stress is caused in a portion having a small thickness and hence it is necessary to add another reinforcing means).

While the embodiments 1 to 6 have been descried for illustrating the present invention, these embodiments may be combined with each other.

While the invention has been shown and described in detail, the foregoing description is in all aspects illustrative and not restrictive. It is therefore understood that numerous modifications and variations can be devised without departing from the scope of the invention.

What is claimed is:

1. A cathode-ray tube comprising:

a vacuum housing being formed by joining side surface portions of a front glass vessel and a back metal vessel with each other, said front glass vessel including a front surface and a fluorescent screen applied to an inner surface of said front glass vessel;

a cathode portion being provided on said back metal vessel side; and electron beam control means for controlling collision of an electron beam being generated from said cathode portion onto said fluorescent screen, said back metal vessel having said side surface portion of a prescribed width extending toward said side surface portion of said front glass vessel and a bottom surface portion opposite to said fluorescent screen of said front glass vessel, said bottom surface portion provided with a depression of a prescribed amount bent toward said fluorescent screen, said back metal vessel further including a corner portion joining said side surface portion and said bottom surface portion said corner portion having a prescribed radius R of curvature.

2. The cathode-ray tube in accordance with claim 1, wherein the front surface of said front glass vessel is substantially flat and wherein said amount d of said depression being provided on said bottom portion and said radius R of curvature of said corner portion are substantially within the following ranges:

$0.3\ h \leqq d \leqq 0.5\ h$ $0.1\ h \leqq R \leqq 0.3\ h$ where h represents a full height of said back metal vessel.

3. The cathode-ray tube in accordance with claim 2, wherein the front surface of said front glass vessel is substantially flat and wherein said amount d of said depression and said radius R of curvature substantially satisfy the following relation:

$R<d<2R$.

4. The cathode-ray tube in accordance with claim 1, wherein the front surface of said front glass vessel is substantially flat and wherein said side surface portion of said back metal vessel is in the form of a substantially rectangular frame having a pair of opposite longer side portions and a pair of opposite shorter side portions, a drawing depth S of said shorter side portions is substantially within the following range:

$0<S \leqq 0.5\ h$ assuming that h represents a full height of said back metal vessel.

5. The cathode-ray tube in accordance with claim 4, wherein said drawing depth S of said shorter side portions is set to be smaller than a drawing depth of said longer side portions.

6. The flat cathode-ray tube in accordance with claim 1, wherein a plurality of rib structures are integrally formed on said bottom surface portion of said back metal vessel.

7. The cathode-ray tube in accordance with claim 1, wherein a radiation fin is arranged on said bottom surface portion of said back metal vessel substantially within said depression.

8. The cathode-ray tube in accordance with claim 1, wherein the front surface of said front glass vessel is substantially flat and wherein $G \leqq 0.25\ h$ in a joint portion between said side surface portions of said front glass vessel and said back metal vessel, wherein G represents the amount of displacement between thickness centers of said side surface portions of said front glass vessel and said back metal vessel and h represents a full height of said back metal vessel.

9. The cathode-ray tube in accordance with claim 1, wherein the front surface of said front glass vessel is substantially flat and, wherein an electric signal input terminal and an exhaust pipe are arranged in the ranges of $L_1/3$ and $L_2/3$ from a face center of said bottom surface portion of said back metal vessel along longer and shorter sides of said bottom surface portion wherein $L_1$ and $L_2$ represent lengths of said longer and shorter sides, respectively.

10. The cathode-ray tube in accordance with claim 1, wherein the front surface of said front glass vessel is substantially flat.

* * * * *

UNITED STATES PATENT AND TRADEMARK OFFICE

CERTIFICATE OF CORRECTION

PATENT NO. : 5,602,443
DATED : FEBRUARY 11, 1997
INVENTOR(S) : Igeta et al.

It is certified that error appears in the above-indentified patent and that said Letters Patent is hereby corrected as shown below:

On the Title page, item [30]:

In Foreign Application Priority Data, line 31, correct the date on which the Japanese application was filed from "June 12, 1994" to --December 6, 1994--.

Signed and Sealed this
Second Day of September, 1997

Bruce Lehman

BRUCE LEHMAN

*Commissioner of Patents and Trademarks*

*Attest:*

*Attesting Officer*